United States Patent [19]

Hornschemeyer

[11] Patent Number: 4,883,286

[45] Date of Patent: Nov. 28, 1989

[54] TOE PIECE FOR SAFETY SKI BINDING

[75] Inventor: Heinz Hornschemeyer, Oberammergau, Fed. Rep. of Germany

[73] Assignee: Marker Deutschland GmbH, Eschenlohe, Fed. Rep. of Germany

[21] Appl. No.: 227,147

[22] Filed: Aug. 2, 1988

[30] Foreign Application Priority Data

Aug. 3, 1987 [DE] Fed. Rep. of Germany ..... 3725709

[51] Int. Cl.[4] ..... A63C 9/085

[52] U.S. Cl. ..... 280/629

[58] Field of Search ..... 280/629, 625, 627, 626, 280/628, 634

[56] References Cited

U.S. PATENT DOCUMENTS

| | | | |
|---|---|---|---|
| 3,380,749 | 4/1968 | Salomon | 280/629 |
| 3,658,355 | 4/1972 | Axthammer | 280/629 |
| 3,719,368 | 3/1973 | Biermann | 280/629 |

FOREIGN PATENT DOCUMENTS

| | | | |
|---|---|---|---|
| 1917117 | 10/1970 | Fed. Rep. of Germany | 280/629 |
| 1964306 | 7/1971 | Fed. Rep. of Germany | 280/629 |
| 1728545 | 11/1974 | Fed. Rep. of Germany | 280/629 |
| 2919266 | 11/1980 | Fed. Rep. of Germany | 280/629 |

*Primary Examiner*—David M. Mitchell

*Attorney, Agent, or Firm*—D. Peter Hochberg; Mark Kusner; Louis J. Weisz

[57] ABSTRACT

A toe piece for holding a ski boot in a safety ski binding wherein the toe piece is pivotable laterally against a biasing force when excessive side forces occur. The toe piece is comprised of a base plate mountable to the upper surface of a ski, a first pivot pin mounted to the base plate, the first pivot pin being disposed to one side of the longitudinal axis of the ski and being perpendicular to the surface thereof, a holding device for holding the sole of the boot, the holding means including an elongated, arcuate opening for receiving one end of the first pivot pin therein, a second pivot pin mounted to the holding means for movement therewith, the second pin being parallel to the first pin and disposed on the other side of the longitudinal axis, a generally elongated link member pivotally mounted at one end to the first pivot pin and pivotally mounted at the other end to the second pivot pin, the link member extending genrally transversely to the longitudinal axis, an elastic device for biasing the soleholder to a central position wherein the soleholder is symmetrically disposed with respect to the longitudinal axis, and a stop member fixed to the base plate operable to cause the soleholder to pivot about the first pivot pin when the boot exerts an outward force in the direction of the first pivot pin, and to pivot about the second pivot pin when the boot exerts an outward force.

7 Claims, 1 Drawing Sheet

TOE PIECE FOR SAFETY SKI BINDING

FIELD OF THE INVENTION

The present invention relates to a toe piece for a safety ski binding.

BACKGROUND OF THE INVENTION

The present invention generally pertains to a toe piece of the type disclosed in U.S. Pat. No. 3,380,749 to Georges P. J. Salomon. Toe pieces of the type disclosed in the aforementioned patent have long been known, but have not met with particular success in the market place. A problem with such designs is that the swivel arm (referred to as a short link in the patent) is operable to bear against a stop in a direction which is opposite to the movement of the ski. As a result, the compression spring which biased the swivel arm is affected by the force applied to the soleholder by the boot. In other words, a force by the boot acting toward the tip end of the ski along the longitudinal axis of the ski will force the swivel arm or link away from the stop. Inasmuch as this longitudinal force will influence the resistance to a lateral release of the boot, such a design does not comply with ideal safety standards. Variations of such designs have been proposed in which the spring is relieved from the clamping pressure. Such designs cannot be actually used, however, because they do not meet the requirements arising during skiing and may even prevent operation of the safety release. In any event, the resistance to release in such devices has an excessive variation, which probably accounts for why such toe units have not found widespread market acceptance.

It has been suggested to provide toe pieces which have a shell-like or cup-like soleholder wherein the soleholder will not move toward the tip end of the ski (within the so called elastic zone) during an outward lateral movement of the boot (see e.g., German Application Nos. 1917117 and 1964306). These applications show structures wherein a displacement toward the skiing boot is initially superimposed on the rotational movement of the soleholder. These designs however generally include a large number of parts and have intricate and delicate structures, and therefore are more likely to be damaged in actual use.

The present invention overcomes these and other problems and provides a toe piece of the type described above which does not move toward the tip of the ski within the so called elastic zone and which is comprised of relatively few moving parts.

SUMMARY OF THE INVENTION

In accordance with the present invention there is provided a toe piece for holding a ski boot in a safety ski binding wherein the toe piece is pivotable laterally against a biasing force when excessive side forces occur. The toe piece is comprised of a base plate mountable to the upper surface of a ski. A first pivot pin is mounted on the base plate, and is disposed to one side of the longitudinal axis of the ski, being perpendicular to the surface thereof. Holding means are provided for holding the sole of the boot. The holding means includes an elongated, arcuate opening for receiving one end of the first pivot pin therein. A second pivot pin is mounted to the holding means for movement therewith. The second pin is parallel to the first pin and disposed on the other side of the longitudinal axis of the ski. A generally elongated link member is pivotally mounted at one end to the first pivot pin and pivotally mounted at the other end to the second pivot pin. The link member extends generally transversely to the longitudinal axis of the ski. Means for biasing the soleholder to a central position are provided wherein the soleholder is symmetrical disposed with respect to the longitudinal axis. A stop member is fixed to the base plate and is operable to cause the soleholder to pivot about the first pivot pin when the boot exerts an outward force in the direction of the first pivot pin, and to pivot about the second pivot pin when the boot exerts an outward force in the direction of the second pivot pin.

It an objection of the present invention to provide a toe piece for a safety ski binding which has a shell-like or cup-like soleholder which does not move toward the tip end of the ski during lateral movement of a ski boot.

Another object of the present invention is to provide a toe piece as described above which meets the requirements of modern skiing and has good restoring characteristics.

A still further object of the present invention is to provide a toe piece as described above which is comprised of relatively few parts wherein the moving parts perform only rotational movements.

These and other objects and advantages will become apparent from the following description of a preferred embodiment taken in together with the accompanying drawings.

DRAWINGS

The invention may take physical form in certain parts and arrangement of parts, a preferred embodiment of which will be described in detail in the specification and illustrated in the accompanying drawings wherein.

PREFERRED EMBODIMENT OF THE PRESENT INVENTION

Figure 1:
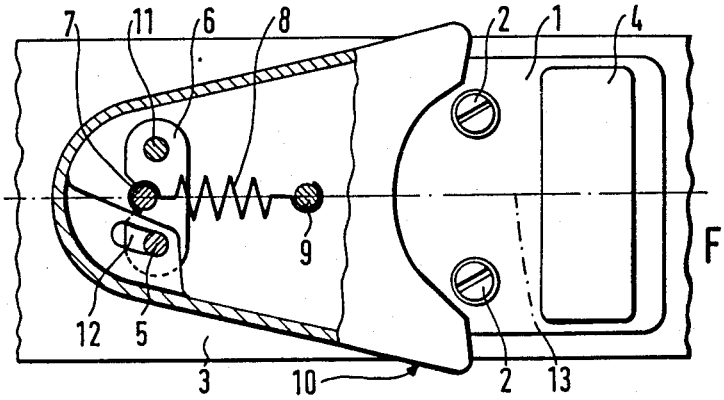
FIG. 1 is a partially sectioned, top plan view of a toe piece for a safety ski binding illustrating a preferred embodiment of the present invention, wherein the toe piece is shown in a normal, central position.

Referring now to the drawings wherein the showings are for the purpose of illustrating a preferred embodiment and not for the purpose of limiting same, FIG. 1 shows a toe piece comprised of a base plate 1, which is secured by means of fastening screws 2 to a ski 3. At one end of the base plate, a slide plate 4 is provided. Slide plate 4 is comprised of a material having a low coefficient of friction and is operable to support the toe portion of the sole of a ski boot in a manner that is conventionally known. The other end of base plate 1 (i.e. the end near the front of the ski) includes a vertical pivot pin 5. A swivel arm or link 6 is pivotally mounted to pivot pin 5. In its normal position (best seen in FIG. 1), swivel arm 6 extends transversely to the direction of the ski and bears against a stop 7. Stop 7 is fixedly mounted to base plate 1 and is adapted to prevent swivel arm 6 from moving out of its normal position toward the tip end or front of the ski 3. Stop 7 is preferably disposed in the vertical, longitudinal center plane 13 of the toe piece.

Stop 7 is comprised of a pin, to which one end of a helical tension spring 8 is attached. The other end of tension spring 8 is connected to a pin 9 on a soleholder 10. For purposes of illustration, the top wall of the soleholder 10 is shown cut away to illustrate more clearly the functional parts of the toe piece. The swivel arm or link 6 is connected at its free or movable end to a pivot pin 11. Pin 11 is generally parallel to pivot pin 5 and, importantly, is mounted to soleholder 10. Pivot pin 5 extends through an arcuate slot 12 through one wall of soleholder 10. Slot 12 is curved about pivot pin 11 as shown in the drawings. Slot 12 is dimensioned such that soleholder 10 is limited to movement in only one direction relative to the normal position shown in FIG. 1. As a result, the force required for a release of the toe piece is the same in either lateral direction. If the force required for release in the inward or outward directions are desired to be different, this can be acomplished by varying the respective distances between the axes of pins 5 and 11 and the longitudinal axis or plane 13 of the toe piece.

Figure 2:
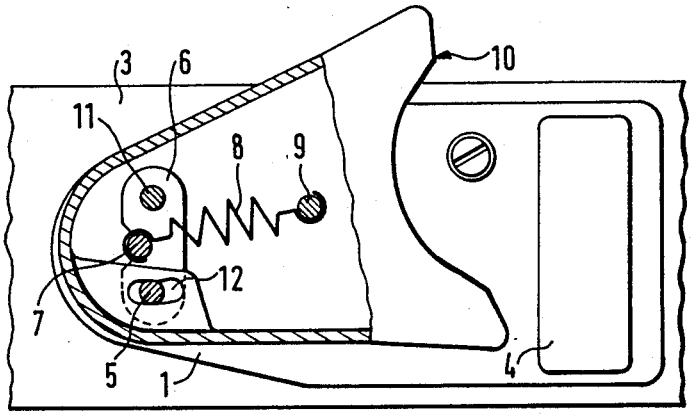
FIG. 2 is a plan view of a toe piece as shown in FIG. 1 showing the soleholder swung to the right when viewed with reference to the direction of movement of the ski.

Referring now to the operation of the binding, the sole of the ski boot may exert a lateral force on soleholder 10 during skiing. FIG. 2 illustrates the condition where the force is directed to the right of ski 3 and exceeds initial stress of helical tension spring 8. In this respect, soleholder 10 will swivel in a counterclockwise direction about pivot pin 11, and helical tension spring 8 will be stressed correspondingly. In this respect, as seen in FIG. 2, stop 7 prevents swivel arm or link 6 from pivoting around pin 5. Consequently, link 6 is maintained stationary and soleholder 10 pivots around pin 11. The angular movement of soleholder 10 is limited by the length of the arcuate slot 12.

Figure 3:
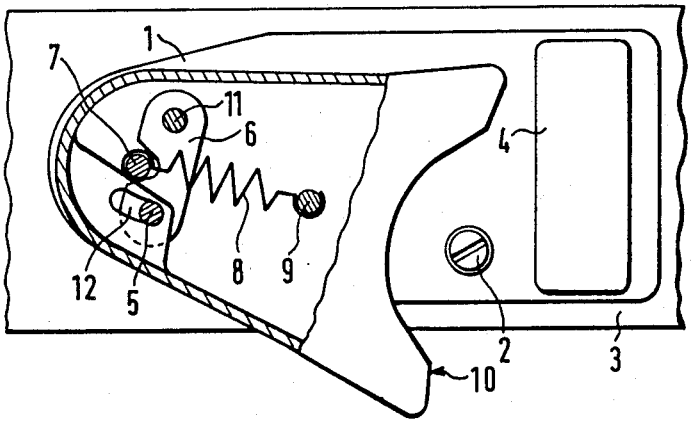
FIG. 3 shows a toe piece as shown in FIG. 1 with the soleholder swung to the left with reference to the direction of the movement of the ski.

If a lateral force is directed to the left of ski 3, and exceeds the initial stress of helical tension spring 8, soleholder 10 will swivel about pivot pin 5 as shown in FIG. 3. As above, pivotal movement of soleholder 10 will cause a corresponding stress in helical tension spring 8. Because pivot pin 11 is connected to soleholder 10 and swivel arm 6, both swivel arm 6 and pin 11 will pivot around pin 5. The pivotal movement of soleholder 10 in this direction may be limited by a portion of the soleholder 10 abutting against stop 7, as shown in FIG. 3 wherein the structure containing arcuate surface 12 engages pin 7. The restoring of soleholder 10 to its normal position will be automatically effected by the helical tension spring 8 when the ski boot has been released or when the force acting in a releasing direction has decreased.

Pin 9 to which one end of tension spring 8 is attached may be adjustable mounted such that the initial stress to the helical tension spring, and consequently the resistance generated by the spring to effect a release, can be modified.

With respect to the present invention, it is essential that the swivel arm or link arm 6 cannot move from its normal position in a direction toward the tip of the ski, and that depending upon the direction of the lateral load exerted on soleholder 10, soleholder 10 will swivel about a pivot pin which is disposed on the side to which the load is being applied. Such a structure insures that the ski boot cannot move toward the tip of the ski when in the so called "elastic zone". As set forth above, such movement toward the tip of the ski would obstruct or even prevent the restoring of the soleholder after a shock when a release of the boot is not required. The present invention has been described with respect to a preferred embodiment. Modifications and alterations will occur to others upon the reading and understanding of this specification. It is intended that all modifications and alterations be included insofar as they come within the scope of the patent as claimed or the equivalents thereof.

Having thus described the invention, the following is claimed:

1. A toe piece for holding a ski boot in a safety ski binding wherein said toe piece is pivotable laterally against a biasing force when excessive side forces occur, said toe piece comprising:

a base plate mountable to the upper surface of a ski;

a first pivot pin mounted to said base plate, said first pivot pin being disposed to one side of the longitudinal axis of said ski and being perpendicular to the surface thereof;

holding means for holding the sole of said boot, said holding means including an elongated, arcuate opening for receiving one end of said first pivot pin therein, a second pivot pin mounted to said holding means for movement therewith, said second pin being parallel to said first pin and disposed on the other side of said longitudinal axis;

a generally elongated link member pivotally mounted at one end to said first pivot pin and pivotally mounted at the other end to said second pivot pin, said link member extending generally transversely to said longitudinal axis; wherein said soleholder is symmetrically disposed with respect to said longitudinal axis; and a stop member fixed to said base plate disposed along the longitudinal axis of said ski operable to cause said soleholder to pivot about said first pivot pin when said boot exerts an outward force toward said one side of said ski, and to pivot about said second pivot pin when said boot exerts an outward force toward said other side of said ski.

2. A toe piece as defined in claim 1 wherein said arcuate opening is centered about said second pivot pin and said first pin moves through said slot when said soleholder pivots about said second pin.

3. A toe piece as defined in claim 1 herein said link member bears against side stop member when said soleholder is in said central position.

4. A toe piece as defined in claim 1 wherein said means for biasing is a helical spring.

5. A toe piece as defined in claim 1 wherein said first and second pivot pins are symmetrically disposed with respect to said longitudinal axis.

6. A toe piece for holding a ski boot in a safety ski binding wherein said toe piece is pivotable laterally against a biasing force when excessive side forces occur, said toe piece comprising:

a base plate mountable to the upper surface of a ski;

a first pivot pin mounted to said base plate, said first pivot pin being disposed to one side of the longitudinal axis of said ski and being perpendicular to the surface thereof;

holding means for holding the sole of said boot, said holding means including an elongated, arcuate opening for receiving one end of said first pivot pin therein, a second pivot pin mounted to said holding means for movement therewith, said second pin being parallel to said first pin and disposed on the other side of said longitudinal axis;

a generally elongated link member pivotally mounted at one end to said first pivot pin and pivotally mounted at the other end to said second pivot pin, said link member extending generally transversely to said longitudinal axis;

means for biasing said soleholder to a central position wherein said soleholder is symmetrically disposed with respect to said longitudinal axis; and a stop member fixed to said base plate operable to cause said soleholder to pivot about said first pivot pin when said boot exerts an outward force toward said one side of said ski, and to pivot about said second pivot pin when said boot exerts an outward force toward said other side of said ski, said means for biasing being connected to said soleholder and said stop member.

7. A toe piece for holding a ski boot in a safety ski binding wherein said toe piece is pivotable laterally against a biasing force when excessive side forces occur, said toe piece comprising:

a base plate mountable to the upper surface of a ski;

a first pivot pin mounted to said base plate, said first pivot pin being disposed to one side of the longitudinal axis of said ski and being perpendicular to the surface thereof;

holding means for holding the sole of said boot, said holding means including an elongated, arcuate opening for receiving one end of said first pivot pin therein, a second pivot pin mounted to said holding means for movement therewith, said second pin being parallel to said first pin and disposed on the other side of said longitudinal axis;

a generally elongated link member pivotally mounted at one end to said first pivot pin and pivotally mounted at the other end to said second pivot pin, said link member extending generally transversely to said longitudinal axis;

means for biasing said soleholder to a central position wherein said soleholder is symmetrically disposed with respect to said longitudinal axis; and a stop member fixed to said base plate operable to cause said soleholder to pivot about said first pivot pin when said boot exerts an outward force toward said one side of said ski, and to pivot about said second pivot pin when said boot exerts an outward force toward said other side of said ski, said means for biasing being a helical spring connected to said soleholder and said stop member.

* * * * *